US012410740B2

(12) United States Patent
Krein et al.

(10) Patent No.: US 12,410,740 B2
(45) Date of Patent: Sep. 9, 2025

(54) METHOD FOR ASCERTAINING AN OPERATING STATE OF A BURNER

(71) Applicant: Robert Bosch GmbH, Stuttgart (DE)

(72) Inventors: William Krein, Neckarzimmern (DE); Chao Zhang, Beilstein (DE); Christian Disch, Wimsheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 18/826,281

(22) Filed: Sep. 6, 2024

(65) Prior Publication Data

US 2025/0092813 A1 Mar. 20, 2025

(30) Foreign Application Priority Data

Sep. 14, 2023 (DE) ..... 10 2023 208 935.1

(51) Int. Cl.

| | |
|---|---|
| ***F01N 11/00*** | (2006.01) |
| ***F01N 3/025*** | (2006.01) |
| ***F01N 3/10*** | (2006.01) |
| ***F01N 3/20*** | (2006.01) |
| ***F01N 9/00*** | (2006.01) |

(52) U.S. Cl.

CPC ..... *F01N 11/002* (2013.01); *F01N 3/101* (2013.01); *F01N 3/20* (2013.01); *F01N 9/00* (2013.01); *F01N 3/025* (2013.01); *F01N 2240/14* (2013.01)

(58) Field of Classification Search

CPC ..... F01N 11/002; F01N 3/101; F01N 3/20; F01N 9/00; F01N 3/025; F01N 2240/14

See application file for complete search history.

(56) References Cited

U.S. PATENT DOCUMENTS

| | | | | |
|---|---|---|---|---|
| 4,708,635 | A * | 11/1987 | Vishwanath | F23C 15/00 60/39.77 |
| 11,898,482 | B2 * | 2/2024 | Di Vieste | F01N 3/2033 |
| 12,104,515 | B2 * | 10/2024 | Zhang | F01N 9/00 |
| 2007/0119147 | A1 * | 5/2007 | Cornwell | F01D 21/003 60/39.281 |
| 2022/0136423 | A1 * | 5/2022 | Hemminger | F01N 3/2033 60/286 |

(Continued)

FOREIGN PATENT DOCUMENTS

| | | |
|---|---|---|
| DE | 4132814 A1 | 4/1993 |
| DE | 19504208 A1 | 8/1995 |

*Primary Examiner* — Matthew T Largi

(74) *Attorney, Agent, or Firm* — NORTON ROSE FULBRIGHT US LLP

(57) ABSTRACT

A method for ascertaining an operating state an exhaust gas burner in an exhaust system of an internal combustion engine. The burner is supplied with air by means of a secondary air system and with fuel by means of a fuel system. Exhaust gas generated in the burner is discharged into the exhaust system of the internal combustion engine. The method includes: detecting a sensor signal of at least one pressure sensor arranged in an air path upstream and/or downstream of the burner; ascertaining an amplitude of at least one periodic partial signal contained in the sensor signal and having a predeterminable frequency; and ascertaining the operating state of the burner depending on the ascertained amplitude. A computing unit, an exhaust system, and a computer program for carrying out the method are also provided.

12 Claims, 6 Drawing Sheets

(56) References Cited

U.S. PATENT DOCUMENTS

| | | | | |
|---|---|---|---|---|
| 2022/0154623 | A1* | 5/2022 | Alva | F01N 3/021 |
| 2023/0049216 | A1* | 2/2023 | Garagnani | F01N 3/035 |
| 2023/0258117 | A1* | 8/2023 | Zhang | F01N 11/00<br>701/29.4 |

* cited by examiner

METHOD FOR ASCERTAINING AN OPERATING STATE OF A BURNER

CROSS REFERENCE

The present application claims the benefit under 35 U.S.C. § 119 of German Patent Application No. DE 10 2023 208 935.1 filed on Sep. 14, 2023, which is expressly incorporated herein by reference in its entirety.

FIELD

The present invention relates to a method for ascertaining an operating state of a burner and to a computing unit and a computer program for carrying out the method, and to a corresponding exhaust system.

BACKGROUND INFORMATION

Three-way catalysts (TWCs), which make it possible to convert the relevant gaseous pollutants NOx, HC and CO into harmless products such as $N_2$, $H_2O$ and $CO_2$, can be used to meet statutory emission limits. For such catalytic reactions to proceed as intended, the temperatures in the catalyst must usually exceed the so-called light-off temperature of typically 300-400° C. As soon as this temperature is reached or exceeded, the catalyst converts the relevant pollutants almost completely (the so-called catalyst window).

In order to achieve this condition as quickly as possible, so-called internal engine catalyst heating measures can be applied. The degree of efficiency of the gasoline engine is thereby worsened by late ignition angles, thus increasing the exhaust gas temperature and the enthalpy input into the catalyst.

Adapted injection strategies (e.g., multiple injections) can simultaneously ensure combustion stability.

In addition to these internal engine catalyst heating measures, external catalyst heating measures can also be used, for example by means of electrically heatable catalysts or exhaust gas burners. Such external heating measures are described, for example, in German Patent Nos. DE 41 32 814 A1 and DE 195 04 208 A1.

In order to further reduce emissions in comparison to conventional operation with internal engine heating measures, in particular during cold departures, i.e., high loads on the internal combustion engine in the cold state without an idling phase, so-called catalyst burners have proven to be an extremely effective measure for accelerating the TWC light-off.

SUMMARY

According to the present invention, a method for ascertaining an operating state of a burner along with a computing unit and a computer program for carrying out the method, and a corresponding exhaust system are provided. Advantageous example embodiments of the present invention are disclosed herein.

The present invention uses a pressure sensor for assessing an operating state of a burner, in particular of an exhaust gas burner in an exhaust system of an internal combustion engine. The sensor is arranged in an air path upstream and/or downstream of the burner. Combustion taking place in the burner causes pressure fluctuations upstream and downstream of the burner, which pressure fluctuations can be evaluated in order to draw conclusions about the operating state of the burner. In particular, a partial signal, which fluctuates periodically with the injection frequency of the fuel metering to the burner, can be extracted from the pressure sensor signal. The amplitude of such a partial signal can be used to ascertain particularly reliably whether the combustion in the burner is functioning or whether the flame has gone out. In embodiments of the invention, partial signals with a different frequency, in particular multiple of the injection frequency, can also be used alternatively or additionally.

In detail, the burner is supplied with air by means of a secondary air system and with fuel by means of a fuel system, and exhaust gas generated in the burner is discharged into an exhaust system, in particular the exhaust system of the internal combustion engine. According to an example embodiment of the present invention, the method comprises detecting a sensor signal of at least one pressure sensor arranged in an air path upstream and/or downstream of the burner, ascertaining an amplitude of at least one periodic partial signal contained in the sensor signal and having a predeterminable frequency, and ascertaining the operating state of the burner depending on the ascertained amplitude.

In at least one example embodiment of the present invention, the method furthermore comprises comparing the ascertained amplitude to a predeterminable threshold value, and ascertaining the operating state as heating (i.e., combustion in the burner is active) if the ascertained amplitude is greater than the threshold value, and ascertaining the operating state as non-heating (i.e., combustion in the burner is inactive or not sufficiently stable) if the ascertained amplitude is less than or equal to the threshold value.

The threshold value can in particular be selected depending on a previously ascertained operating state, in particular wherein the threshold value is increased if the previously ascertained operating state is a non-heating operating state, and/or wherein the threshold value is reduced if the previously ascertained operating state is a heating operating state. In particular at the beginning of combustion, the amplitude of the pressure signal is high, since the burner is still cold in this state and each flame burst is therefore accompanied by a larger volume expansion (and thus pressure surge) than is the case when the burner is already hot.

In example embodiments of the present invention, the predeterminable frequency of the at least one partial signal can be equal to an injection frequency in the context of supplying fuel to the burner and/or equal to a multiple of the injection frequency. As already mentioned at the beginning, this can be used to ascertain particularly reliably whether the combustion in the burner takes place in a stable manner.

In particular, within the scope of example embodiments of the present invention, when controlling the burner, the injection frequency of the burner and/or its multiple is selected to be different from a rotation frequency of the internal combustion engine and the multiple thereof. The partial signal generated by the combustion in the burner can thus be easily distinguished from the pressure fluctuations generated in the exhaust system by the internal combustion engine.

In at least one example embodiment of the present invention, the amplitude of the at least one periodic partial signal is ascertained using a Fourier transform of the sensor signal. This is a particularly simple way to extract periodic or at least partially periodic partial signals from a combined signal.

In at least one example embodiment of the present invention, the ascertainment of the operating state is repeated more than one, two, three, five, ten or more than twenty times per second. Substantially continuous monitoring of the burner can thus be realized, so that, in the event of (unintentional) extinguishing, a quick response is possible in order to improve the emission behavior of the burner or of the internal combustion engine as a whole.

Alternatively or additionally, in example embodiments of the present invention, the ascertainment of the operating state can be completed for the first time no later than 1 s, 0.5 s, 0.3 s, 0.1 s or no later than 0.05 s after a start of the supply of fuel to the burner. It is thus possible to monitor the operation of the burner immediately after it has been started, which is generally not possible with other sensor technologies. For example, a temperature sensor is in principle able to reliably detect a burner operating state. The temperatures measured at the burner outlet are directly related to the combustion in the combustion chamber of the burner. However, the temperature sensor is only able to reliably indicate the operating state of the burner much later than the pressure sensor used according to the invention, since the thermal behavior of the exhaust system is much slower than the pressure behavior. The situation is similar with chemical sensors, for example a lambda probe, which must first be heated to a minimum operating temperature before it is ready for use. A lambda probe is thus likewise only ready for use well after the burner has started operating. The higher the number of unburned injections, the higher the raw emissions of the burner. In particular, in individual cases, the resulting hydrocarbon emissions alone can already exceed statutory limits (e.g., in the case of exhaust emission standards for motor vehicles). Rapid combustion detection is thus a basic requirement for safe and robust burner operation. The sensors mentioned for temperature or air-fuel ratio are therefore less suitable for monitoring the burner start.

In at least one example embodiment of the present invention, the method comprises carrying out a measure depending on the ascertained operating state, wherein the measure in particular comprises issuing a warning message and/or switching off the fuel system and/or switching off the secondary air system and/or blocking the internal combustion engine and/or activating an ignition of the burner.

A computing unit according to the present invention, e.g. a control unit of a motor vehicle, is configured, in particular programmatically, to carry out a method according to the present invention.

An exhaust system according to the present invention for an internal combustion engine comprises at least one burner configured to heat at least one component of the exhaust system, in particular a catalyst; at least one pressure sensor in an air path upstream and/or downstream of the burner; and a computing unit according to the present invention, wherein the at least one sensor is connected to the computing unit in a signal-conducting manner. The exhaust system thus correspondingly benefits from the advantages already explained with respect to the method of the present invention.

Furthermore, the implementation of a method according to the present invention in the form of a computer program or computer program product having program code for carrying out all the method steps is advantageous because it is particularly low-cost, in particular if an executing control unit is also used for further tasks and is therefore present anyway. Finally, a machine-readable storage medium is provided with a computer program as described above stored thereon. Suitable storage media or data carriers for providing the computer program are, in particular, magnetic, optical, and electric storage media, such as hard disks, flash memory, EEPROMs, DVDs, and others. It is also possible to download a program via computer networks (Internet, intranet, etc.). Such a download can be wired or wireless (e.g., via a WLAN network or a 3G, 4G, 5G or 6G connection, etc.).

Further advantages and example embodiments of the present invention can be found in the description and the figures.

The present invention is shown schematically in the figures on the basis of exemplary embodiments and is described below with reference to the figures.

DETAILED DESCRIPTION OF EXAMPLE EMBODIMENTS

Figure 1:
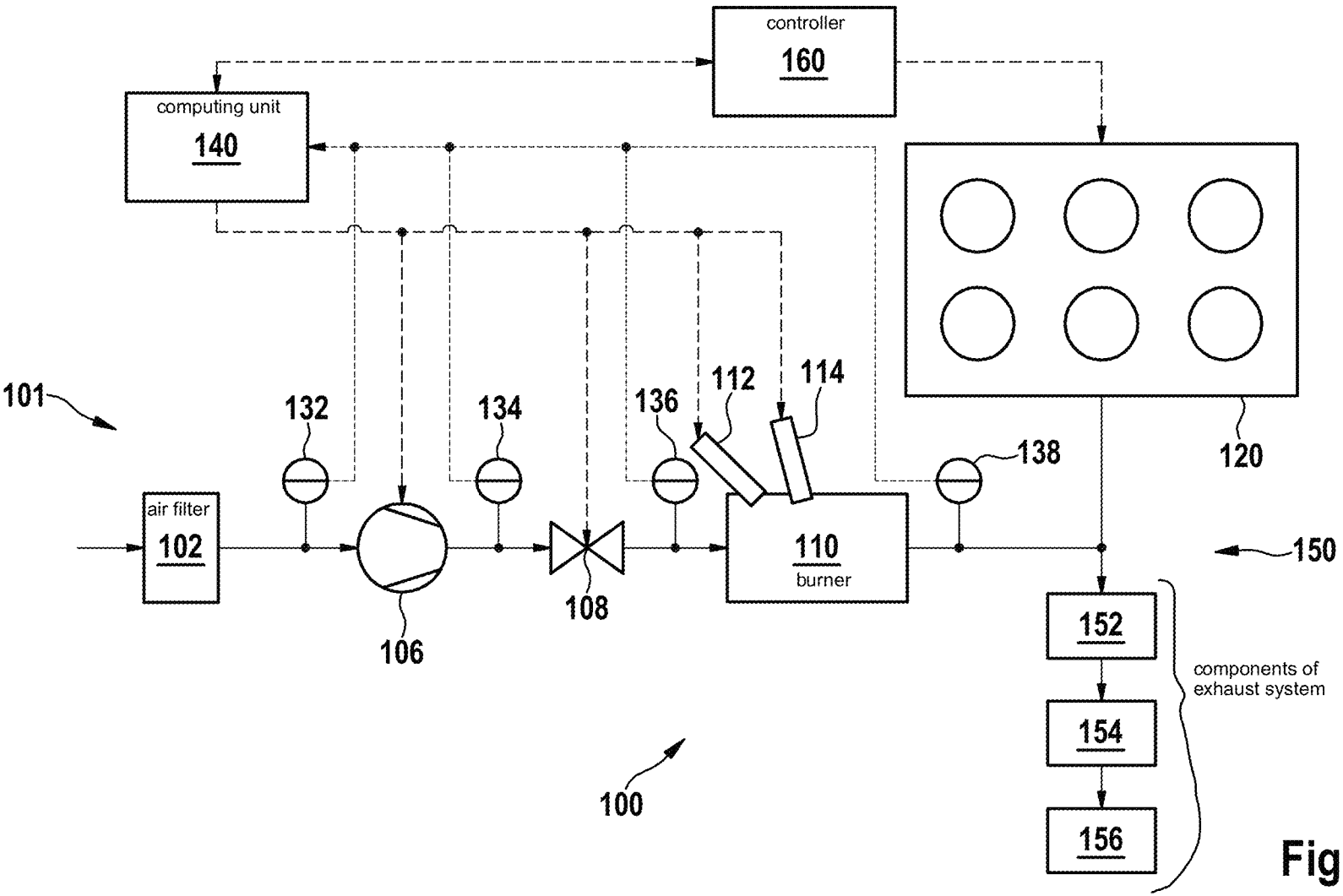
FIG. 1 schematically shows an example embodiment of an exhaust system according to the present invention.

In FIG. 1, an embodiment of an exhaust system according to the present invention, for example an exhaust system of a vehicle, is shown schematically using a block diagram and denoted as a whole by 100. The exhaust system 100 comprises a secondary air system 101 with a burner 110 and an exhaust aftertreatment system 150, which is arranged downstream of the burner 110 and downstream of an internal combustion engine 120 and here has, for example, three components 152, 154, 156 (e.g., catalysts, particle filters or the like).

The secondary air system 101 upstream of the burner 110 comprises an air filter 102, a secondary air pump 106 and an air valve 108. The burner 110 comprises a fuel metering device, in particular an injection device 112 and an ignition device 114. At least one pressure sensor is provided in the air path upstream and/or downstream of the burner 110, i.e., within the secondary air system 101. An absolute pressure sensor or a differential pressure sensor can be used as the pressure sensor. In FIG. 1, possible installation positions in this respect are marked with 132, 134, 136 or 138. However, for the invention, a single pressure sensor at one of these possible installation positions 132, 134, 136, 138 is sufficient. Typically, a sensor is installed in the Installation position 132 anyway, in particular an air-flow sensor, which optionally comprises further sensors, for example temperature sensors or the like. A chemical sensor for monitoring the exhaust gas composition of the burner 110, for example a lambda probe, can be provided at installation position 138. In at least one embodiment of the invention, the pressure sensor can be integrated into such an already existing sensor (e.g., in installation position 132 or 138).

The sensor(s) (132, 134, 136, 138) are connected in a signal-conducting manner to a computing unit 140, for example a control unit of the burner 110. The signal line can be partially or completely wireless or wired. In the example shown here, the computing unit 140 is configured to control the burner 110 and, for this purpose, is connected in a signal-conducting manner to the secondary air pump 106, the air valve 108, the injection device 112 and the ignition device 114. Furthermore, the computing unit 140 can be communicatively connected to a controller 160 of the internal combustion engine 120.

Figure 2:
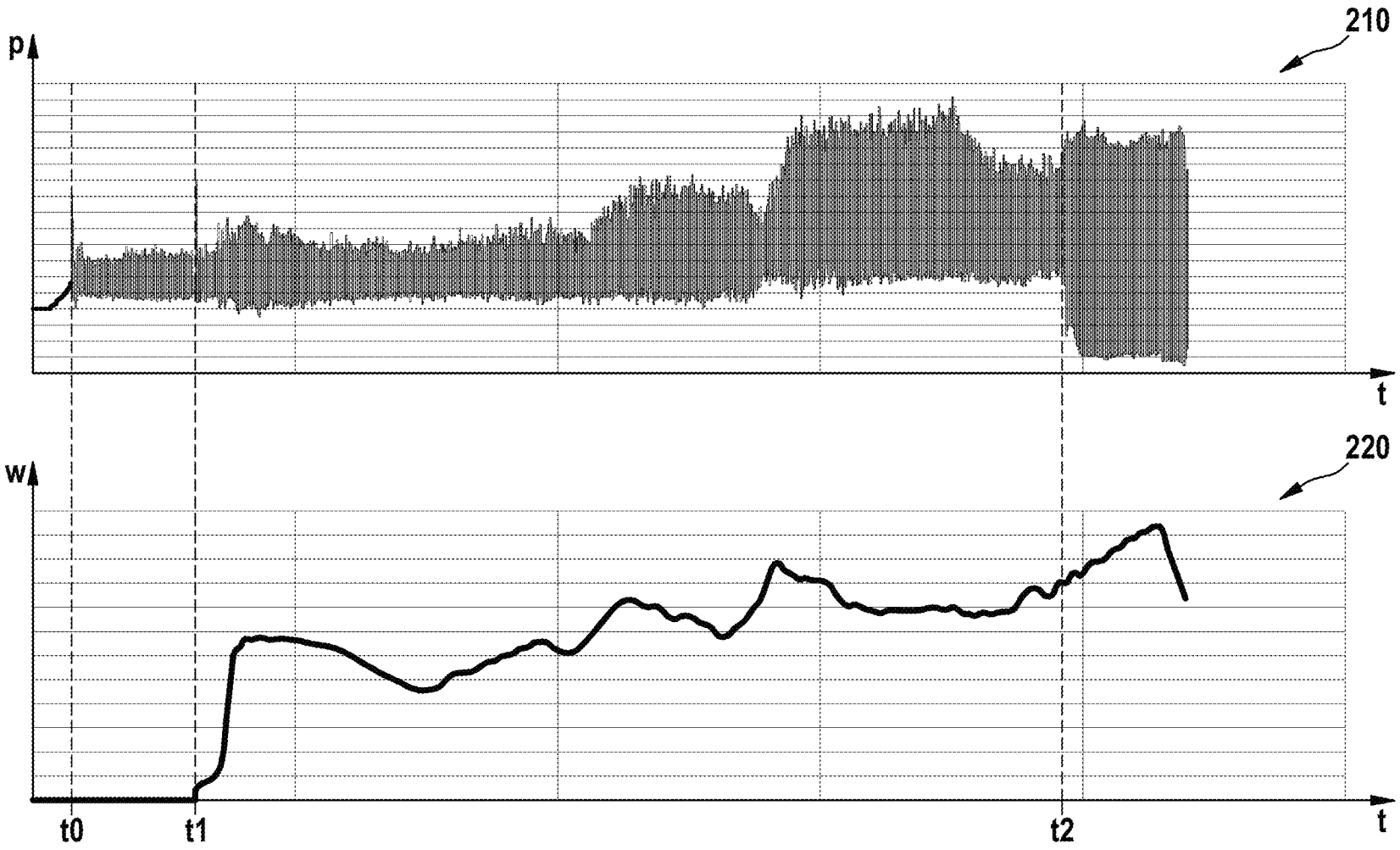
FIG. 2 shows sensor signals as they can be obtained in example embodiments of the present invention.

In FIG. 2, sensor signals as can be obtained in embodiments of the invention are shown using diagrams 210, 220 over a common time axis t. A signal p of the pressure sensor is plotted over time t in diagram 210, and a signal of a tachometer, which detects the rotational speed w of the internal combustion engine 120, is plotted over time t in diagram 220. A point in time to denotes the start of the burner 110, and a point in time t1 denotes the start of the internal combustion engine 120. t2 marks an end of the operation of the burner 110. Diagram 210 shows that, as the burner starts operating, the pressure fluctuations in the secondary air system increase. The internal combustion engine 120 also has a significant influence on these fluctuations in the pressure signal. However, it is also clearly visible that it is not reliably possible to clearly identify the operating state of the burner 110 from the raw signal alone, as shown in diagram 210, since an increase in the fluctuation amplitude can indicate both combustion in the burner 110 (t0) and extinguishing of the burner (t2).

Figure 3:
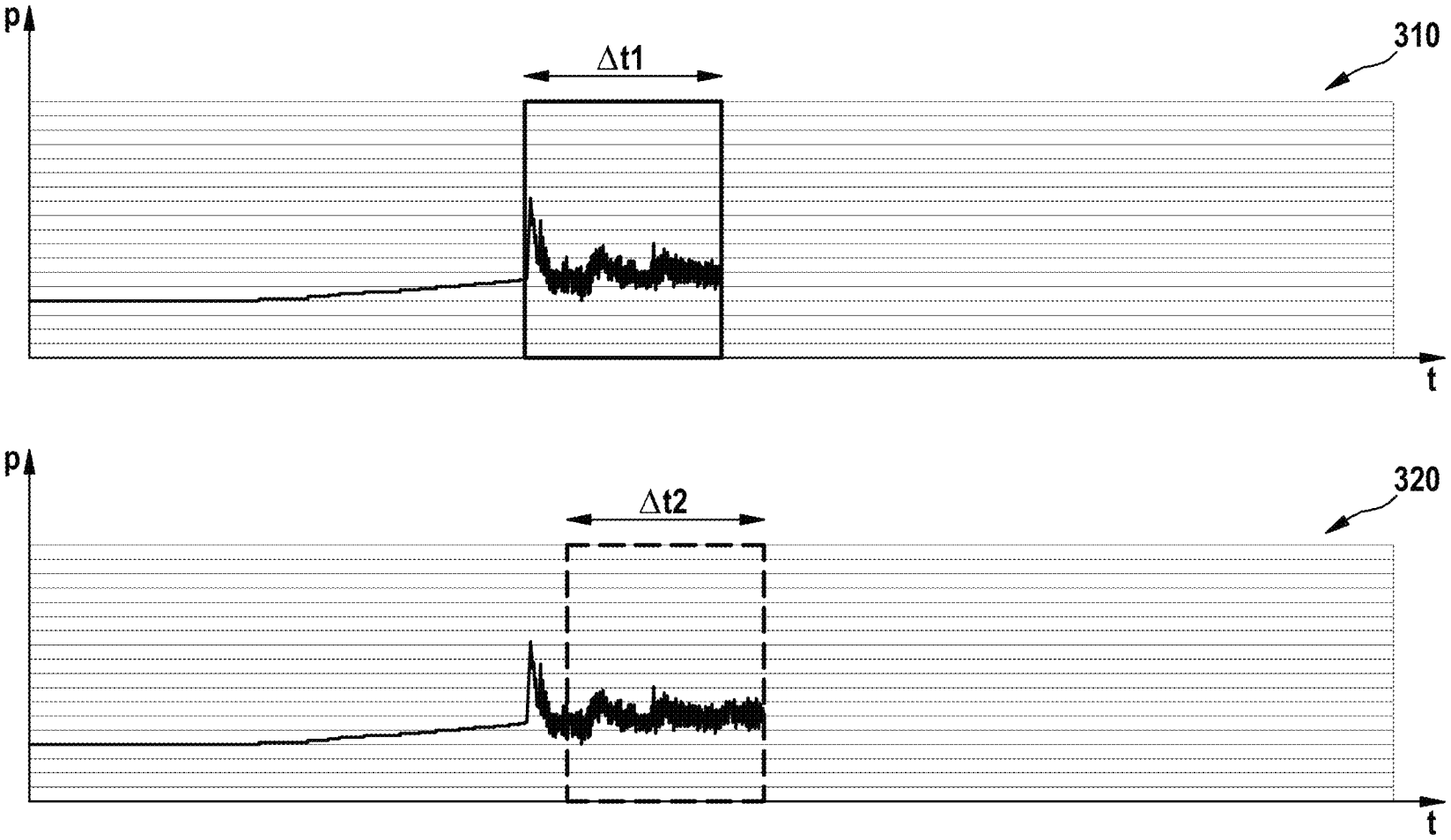
FIG. 3 illustrates how a sensor signal can be used within the scope of example embodiments of the present invention.
Figure 5:
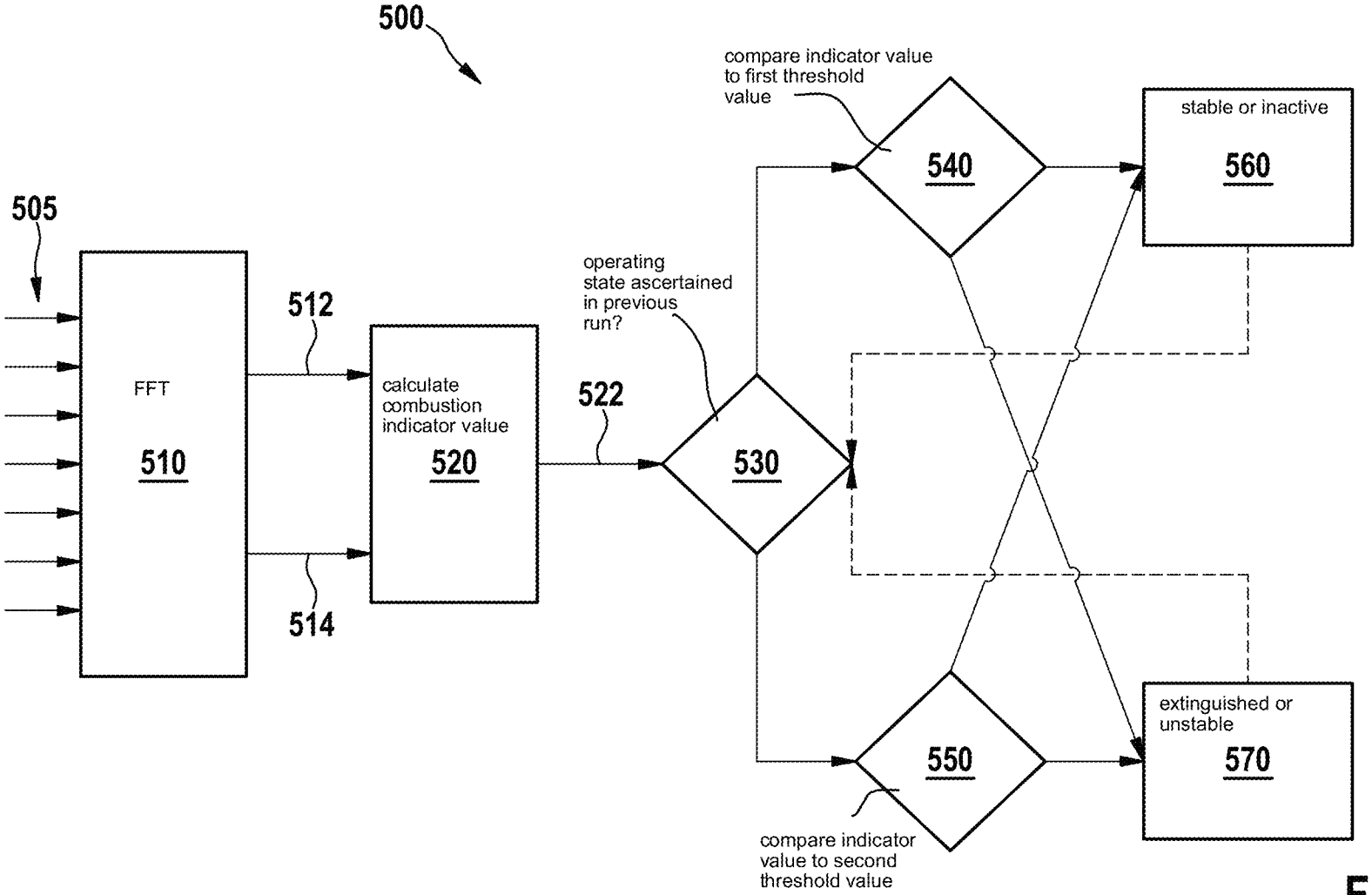
FIG. 5 schematically shows an example embodiment of a method according to the present invention.

FIG. 3 illustrates how the pressure sensor signal shown in FIG. 2 (diagram 210) can be used within the scope of embodiments of the invention. In FIG. 5, a corresponding embodiment of a method according to the invention is shown and denoted as a whole by 500. The method 500 can in particular be used in connection with the exhaust system 100 shown in FIG. 1, but is in no way limited to this specific exhaust system 100. If reference is made below to device components, these references may in particular refer to the exhaust system 100. However, the method 500 can also be used with other suitable exhaust systems, so that such references are for illustrative purposes only and should not be understood to mean that the exact design of the exhaust system 100 is required for certain method steps. Within the scope of the method 500, the pressure sensor signal p(t) as shown in diagram 210 in FIG. 2 can in particular be used. Within the scope of the method 500, the sensor signal p(t) is evaluated for a plurality of consecutive time steps. In FIG. 3, a first diagram 310 and a second diagram 320 represent two consecutive observation steps, wherein the time intervals examined (i.e., details of the respective diagram 310, 320) are marked with Δt1 and Δt2, respectively. In the example shown, the time intervals Δt1 and Δt2 are of equal length but start at different points in time. For example, the start times of two consecutive observation periods can be less than 100 ms apart.

Figure 4:
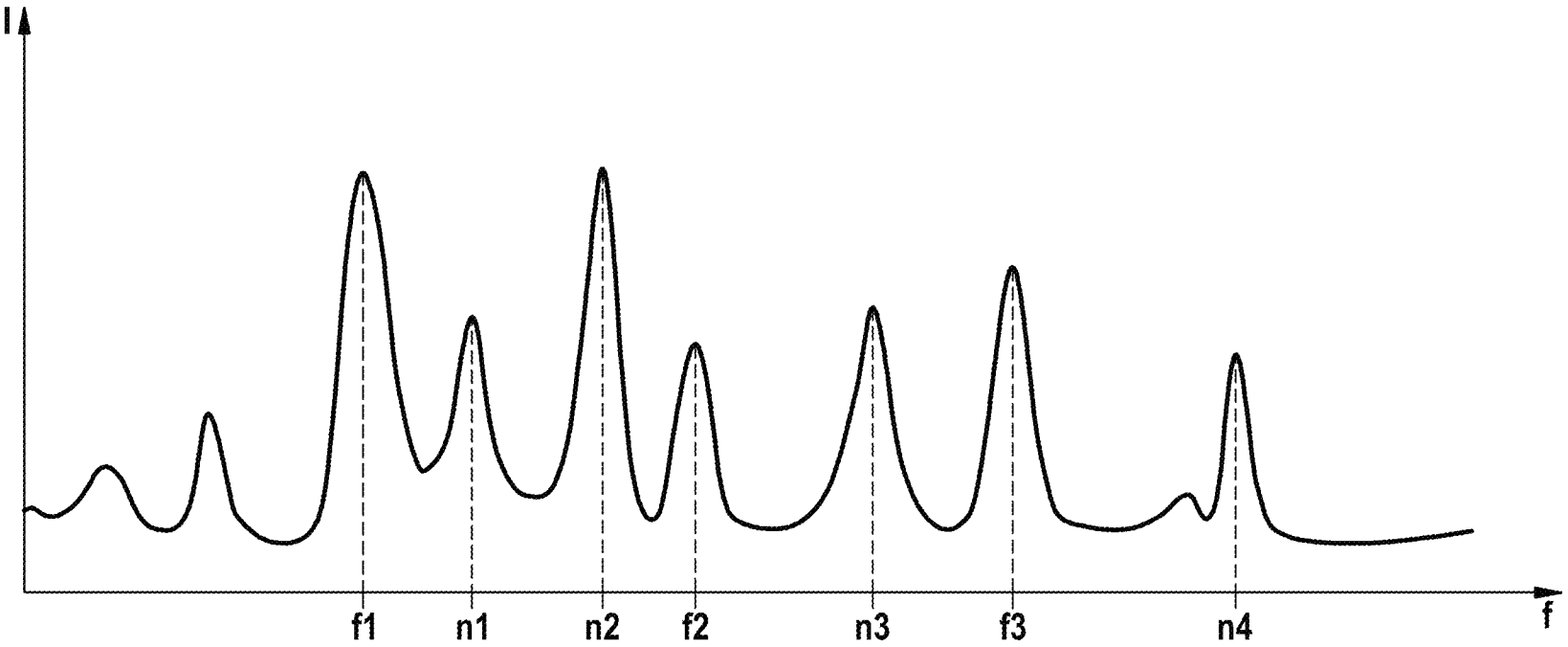
FIG. 4 shows a partial signal of a sensor signal that can be used within the scope of example embodiments of the present invention.

Within the scope of the invention, at least one periodic partial signal is ascertained from the pressure signal p(t) for each such observation period Δt1, Δt2. In FIG. 4, a plurality of such partial signals is shown in the form of a diagram I(f), where I stands for the signal amplitude and f for the frequency of the respective partial signal. Such an I(f) diagram can be ascertained for each time step Δt1, Δt2. For this purpose, in a step 510 of the method 500, a Fourier transform is carried out, in particular in the form of a fast Fourier transform (FFT) or a discrete Fourier transform. It is particularly advantageous to evaluate only partial signals of very narrow frequency bands, in particular in the range of the injection frequency f1 shown in FIG. 4 and/or the multiple f2, f3 thereof. Further frequencies shown in FIG. 4 with high signal amplitude (frequency bands n1, n2, n3, n4) are frequencies at which the exhaust system 100 or the secondary air system 101 is excited to resonant vibrations. These are in particular dependent on operating parameters of the exhaust system, e.g., absolute pressure, temperature, geometry and the like, and are therefore generally variable, whereas the maxima at f1, f2, f3 do not move in the frequency domain when the injection frequency is constant. Optionally, sound pressure maxima determined by the hardware can also be included. For step 510, in addition to the pressure signal over the respective observation interval Δt1, Δt2, further input variables 505, such as exhaust gas temperature, temperature of one or more components of the exhaust system 100, ambient pressure, natural frequencies of the exhaust system, injection frequency of the burner 110 and/or of the internal combustion engine 120, lambda signal from downstream of the burner 110 and/or downstream of the internal combustion engine 120 and the like, can be used, in particular in order to select one or more suitable frequencies for the evaluation at which the pressure signal is influenced as little as possible by other factors.

In principle, it is sufficient for monitoring to analyze only a single suitable frequency, for example the injection frequency of the burner 110. In order to ensure a robust evaluation, it is advisable to also analyze further frequencies as redundancy. This can also be implemented with little computing power on the control unit in the method used. From the evaluation 510 of the selected frequency bands (here two, e.g., f1, f2), amplitudes 512, 514, in particular integrals over a narrow frequency band around the selected frequency f1, f2, are output. They are processed in a step 520 to calculate a combustion indicator value 522. For example, the calculation 520 can comprise applying one or more mathematical operations, such as summation, division, multiplication, averaging or the like, to the amplitudes 512, 514.

On the basis of the indicator value 522, an operating state of the burner 110 is subsequently ascertained. For this purpose, it is first ascertained in a step 530 what the operating state ascertained in a previous run of the method 500 was. If the combustion was previously ascertained as active, the method 500 proceeds to a step 540, in which the indicator value 522 is compared to a first threshold value. If the indicator value 522 is below the first threshold value, the method 500 ascertains in a step 570 that the combustion in the burner 110 has been extinguished or is unstable, and, if necessary, carries out one or more countermeasures, for example by activating the ignition device 114, adjusting the injection quantity of the injection device 112, deactivating the burner 110, blocking a start of the internal combustion engine 120, issuing a warning message or the like. In some embodiments, the choice of the specific measure to be carried out can be made dependent on further influencing variables, for example, exhaust gas lambda value, temperature of one or more components of the exhaust system 100 or the like. The method can return from step 570 to step 510 in order to continue monitoring the combustion or to ascertain whether any measures taken are successful.

If, however, it is ascertained in step 540 that the indicator value 522 is above or at the first threshold value, it is ascertained in a step 560 that the combustion in the burner 110 is stable or active, and the method 500 can return to step 510 in order to monitor the further course of the burner operation.

If it was ascertained in step 530 that the combustion in the burner 110 was previously inactive or unstable, the method proceeds to a step 550, in which the indicator value 522 is compared to a second threshold value, which can in particular have a greater magnitude than the first threshold value. Analogously to the step 540 already explained above, the method 500 proceeds to step 570 (indicator value 522 less than the second threshold value) or 560 (indicator value 522 greater than or equal to the second threshold value) depending on the result of this comparison and afterward returns to step 510 if necessary. The result of the method 500, i.e., step 560 or 570, is returned to the step 530 of the subsequent method run in order to be able to carry out the corresponding sequence of steps (or the corresponding selection between the first and the second threshold value).

Figure 6:
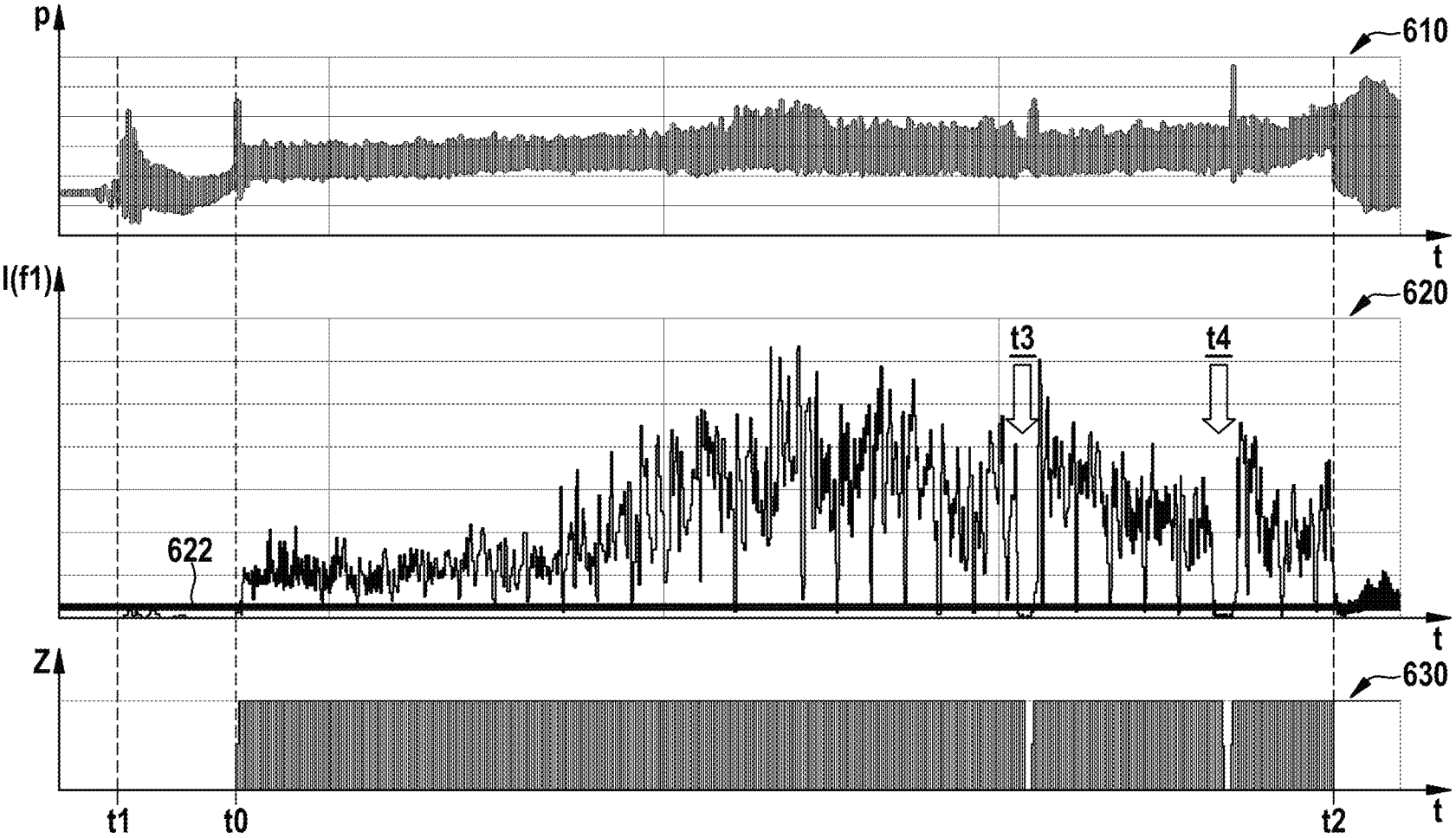
FIG. 6 shows, by way of example, the effect of an example embodiment of the present invention, in particular of the method of FIG. 5.

FIG. 6 shows, by way of example, the effect of an embodiment of the invention, in particular of the method 500 as shown in FIG. 5. Three diagrams 610, 620, 630 are shown, which share a common time axis t. Diagram 610 represents the sensor signal p(t), diagram 620 represents a signal amplitude I(f1) of a partial signal with the frequency f1 that was ascertained from the sensor signal 610, or the indicator value 522 already explained with reference to FIG. 5, and diagram 630 shows the result of ascertaining the operating state Z of the burner 110, with a high signal level representing active or stable combustion and a low signal level representing inactive or unstable combustion in the burner 110.

The diagrams 610, 620, 630 were included for demonstration purposes. The internal combustion engine 120 was started at a point in time t1, while the burner 110 (in contrast to the example shown in FIG. 2) was only started afterward at a point in time to. At points in time t3 and t4, the injection device 112 of the burner 110 was deactivated for a short time, so that the combustion in the burner became unstable or was extinguished at these points in time. At point in time t2, burner 110 was deactivated.

As can be clearly seen, the operation of the internal combustion engine 120 generates a pressure signal that has significant fluctuations (period between t1 and to in diagram 610). However, only a very low signal can be seen in diagram 620 during this period, since these pressure fluctuations are not in the frequency band under consideration, so that the amplitude I(f1) of the partial signal under consideration is low and in particular below a threshold value 622 during this period. However, immediately after activation of the burner 110 (t0), this amplitude I(f1) increases sharply and substantially remains high throughout the entire burner operation. At points in time t3, t4, when the burner operation was intentionally interrupted for a short time, this amplitude suddenly drops to almost zero. Accordingly, as illustrated in diagram 630, the operating state Z of the burner 110 is ascertained as heating (active) with the exception of the intentional interruptions in operation (t3, t4), while the operating state Z is also ascertained as non-heating (inactive) precisely at the points in time at which the operation was actually interrupted. The raw signal p, as shown in diagram 610, also shows increased fluctuations at these points in time, but these fluctuations cannot be easily assigned to a specific operating state of the burner 110 or internal combustion engine 120. However, as the evaluation of the frequency-specific signal analysis (diagram 620) shows, this assignment is reliably possible using the invention.

What is claimed is:

1. A method for ascertaining an operating state of an exhaust gas burner in an exhaust system of an internal combustion engine, wherein the burner is supplied with air by a secondary air system and with fuel by a fuel system, and wherein exhaust gas generated in the burner is discharged into the exhaust system of the internal combustion engine, the method comprising the following steps:

detecting a sensor signal of at least one pressure sensor arranged in an air path upstream and/or downstream of the burner;

ascertaining an amplitude of at least one periodic partial signal contained in the sensor signal and having a predeterminable frequency;

ascertaining the operating state of the burner depending on the ascertained amplitude; and comparing the ascertained amplitude to a predeterminable threshold value, and ascertaining the operating state as heating when the ascertained amplitude is greater than the threshold value, and ascertaining the operating state as non-heating when the ascertained amplitude is less than or equal to the threshold value, wherein the threshold value is selected depending on a previously ascertained operating state of the burner, and: (i) the threshold value is increased when the previously ascertained operating state is non-heating, and/or (ii) the threshold value is reduced when the previously ascertained operating state is heating; and carrying out a measure depending on the ascertained operating state, wherein the measure includes: switching off the fuel system and/or switching off the secondary air system and/or blocking the internal combustion engine and/or activating an ignition of the burner when the operating state was ascertained as non-heating.

2. The method according to claim 1, wherein the predeterminable frequency of the at least one partial signal is equal to: (i) an injection frequency in the context of supplying fuel to the burner and/or (ii) a multiple of the injection frequency.

3. The method according to claim 1, wherein the amplitude of the at least one periodic partial signal is ascertained using a Fourier transform of the sensor signal.

4. The method according to claim 1, wherein the ascertainment of the operating state is repeated more than one time per second.

5. The method according to claim 1, wherein the ascertainment of the operating state is completed for a first time no later than 1 s after a start of the supply of fuel to the burner.

6. The method according to claim 1, wherein the measure further includes: issuing a warning message.

7. A method for ascertaining an operating state of an exhaust gas burner in an exhaust system of an internal combustion engine, wherein the burner is supplied with air by a secondary air system and with fuel by a fuel system, and wherein exhaust gas generated in the burner is discharged into the exhaust system of the internal combustion engine, the method comprising the following steps:

detecting a sensor signal of at least one pressure sensor arranged in an air path upstream and/or downstream of the burner;

ascertaining an amplitude of at least one periodic partial signal contained in the sensor signal and having a predeterminable frequency;

ascertaining the operating state of the burner depending on the ascertained amplitude; and carrying out a measure depending on the ascertained operating state, wherein the measure includes: switching off the fuel system and/or switching off the secondary air system and/or blocking the internal combustion engine and/or activating an ignition of the burner when the operating state was ascertained as non-heating;

wherein the predeterminable frequency of the at least one partial signal is equal to: (i) an injection frequency in the context of supplying fuel to the burner and/or (ii) a multiple of the injection frequency, and wherein the injection frequency of the burner and/or the multiple of the injection frequency is selected to be different from a rotation frequency of the internal combustion engine and a multiple of the rotation frequency.

8. The method according to claim 7, further comprising:

comparing the ascertained amplitude to a predeterminable threshold value, and ascertaining the operating state as heating when the ascertained amplitude is greater than the threshold value, and ascertaining the operating state as non-heating when the ascertained amplitude is less than or equal to the threshold value.

9. The method according to claim 8, wherein the threshold value is selected depending on a previously ascertained operating state, and: (i) the threshold value is increased when the previously ascertained operating state is non-heating, and/or (ii) the threshold value is reduced when the previously ascertained operating state is heating.

10. A computing unit configured to ascertain an operating state of an exhaust gas burner in an exhaust system of an internal combustion engine, wherein the burner is supplied with air by a secondary air system and with fuel by a fuel system, and wherein exhaust gas generated in the burner is discharged into the exhaust system of the internal combustion engine, the computing unit configured to:

detect a sensor signal of at least one pressure sensor arranged in an air path upstream and/or downstream of the burner;

ascertain an amplitude of at least one periodic partial signal contained in the sensor signal and having a predeterminable frequency;

ascertain the operating state of the burner depending on the ascertained amplitude; and carrying out a measure depending on the ascertained operating state, wherein the measure includes: switching off the fuel system and/or switching off the secondary air system and/or blocking the internal combustion engine and/or activating an ignition of the burner when the operating state was ascertained as non-heating;

wherein the predeterminable frequency of the at least one partial signal is equal to: (i) an injection frequency in the context of supplying fuel to the burner and/or (ii) a multiple of the injection frequency, and wherein the injection frequency of the burner and/or the multiple of the injection frequency is selected to be different from a rotation frequency of the internal combustion engine and a multiple of the rotation frequency.

11. An exhaust system for an internal combustion engine, comprising:

at least one burner configured to heat at least one component of the exhaust system, the at least one component being a catalyst;

at least one pressure sensor in an air path upstream and/or downstream of the at least one burner; and a computing unit, wherein the at least one sensor is connected to the computing unit in a signal-conducting manner;

wherein the computing unit is configured to:

detect a sensor signal of the at least one pressure sensor arranged in the air path upstream and/or downstream of the at least one burner, ascertain an amplitude of at least one periodic partial signal contained in the sensor signal and having a predeterminable frequency, ascertain the operating state of the at least one burner depending on the ascertained amplitude; and carry out a measure depending on the ascertained operating state, wherein the measure includes: switching off the fuel system and/or switching off the secondary air system and/or blocking the internal combustion engine and/or activating an ignition of the at least one burner when the operating state was ascertained as non-heating;

wherein the predeterminable frequency of the at least one partial signal is equal to: (i) an injection frequency in the context of supplying fuel to the at least one burner and/or (ii) a multiple of the injection frequency, and wherein the injection frequency of the at least one burner and/or the multiple of the injection frequency is selected to be different from a rotation frequency of the internal combustion engine and a multiple of the rotation frequency.

12. A non-transitory machine-readable storage medium on which is stored a computer program for ascertaining an operating state of an exhaust gas burner in an exhaust system of an internal combustion engine, wherein the burner is supplied with air by a secondary air system and with fuel by a fuel system, and wherein exhaust gas generated in the burner is discharged into the exhaust system of the internal combustion engine, the computer program, when executed by a computer, causing the computer to perform the following steps:

detecting a sensor signal of at least one pressure sensor arranged in an air path upstream and/or downstream of the burner;

ascertaining an amplitude of at least one periodic partial signal contained in the sensor signal and having a predeterminable frequency; and ascertaining the operating state of the burner depending on the ascertained amplitude; and carrying out a measure depending on the ascertained operating state, wherein the measure includes: switching off the fuel system and/or switching off the secondary air system and/or blocking the internal combustion engine and/or activating an ignition of the burner when the operating state was ascertained as non-heating;

wherein the predeterminable frequency of the at least one partial signal is equal to: (i) an injection frequency in the context of supplying fuel to the burner and/or (ii) a multiple of the injection frequency, and wherein the injection frequency of the burner and/or the multiple of the injection frequency is selected to be different from a rotation frequency of the internal combustion engine and a multiple of the rotation frequency.

* * * * *